US006273765B1

(12) United States Patent
Lalaouna et al.

(10) Patent No.: US 6,273,765 B1
(45) Date of Patent: Aug. 14, 2001

(54) WEDGE CONNECTOR WITH INSULATION PERFORATING DEVICE

(75) Inventors: Said Lalaouna, Barcelona; Marcel L. De Keyser, Sant Esteve de Sesrovires, both of (ES)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/601,689

(22) PCT Filed: Feb. 11, 1999

(86) PCT No.: PCT/IB99/00247

§ 371 Date: Sep. 21, 2000

§ 102(e) Date: Sep. 21, 2000

(87) PCT Pub. No.: WO99/41806

PCT Pub. Date: Aug. 19, 1999

(30) Foreign Application Priority Data

Feb. 16, 1998 (ES) ..... 9800302

(51) Int. Cl.[7] ..... H01R 4/50

(52) U.S. Cl. ..... 439/784; 174/94

(58) Field of Search ..... 439/783, 393, 439/435, 477, 413; 124/94

(56) References Cited

U.S. PATENT DOCUMENTS

| | | | | |
|---|---|---|---|---|
| 3,462,543 | * | 8/1969 | Wahl et al. | 439/783 |
| 5,145,420 | | 9/1992 | Counsel et al. | 439/783 |
| 5,842,893 | * | 12/1998 | De Kersey | 439/783 |

FOREIGN PATENT DOCUMENTS

| | | |
|---|---|---|
| 0762543 A1 | 3/1997 | (EP) . |
| 0810688 A1 | 12/1997 | (EP) . |

* cited by examiner

*Primary Examiner*—Brian Sircus
*Assistant Examiner*—Phuong Dinh
(74) *Attorney, Agent, or Firm*—Perman & Green, LLP

(57) ABSTRACT

A wedge connector provided with an insulating covering, comprising: an external C-shaped member (2), having two first curved wings (10), the respective bottoms (12) of which are mutually inclined; a wedge member (6) having two mutually inclined concave active edges (14); and at least one intermediate member (4) which [i] comprises electrically conducting material; [ii] is adapted to be located between the external member (2) and said wedge member (6); [iii] is provided with a plurality of perforating teeth (22); and [iv] surrounds in part at least one portion of a conductor (20) disposed between the wedge member (6) and the intermediate member (4).

7 Claims, 2 Drawing Sheets

WEDGE CONNECTOR WITH INSULATION PERFORATING DEVICE

DESCRIPTION

1. Field of the Invention

The invention relates to a wedge connector with insulation perforating device, for connecting electrical conductors provided with an insulating covering, comprising: [a] an external C-shaped member, determining two first curved wings, the respective bottoms of which define mutually inclined longitudinal lines; [b] a wedge member having two mutually inclined concave active edges; and [c] at least one intermediate member comprising electrically conducting material and which is adapted to be located between said external member and said wedge member.

2. Prior Art Reference

Document EP 0 810 688 describes a connector for obtaining an electrical bridge between two electrical conductors having an insulating covering. This bridge is based on an electrically conducting intermediate member provided externally with perforating means which may be applied to portions of two insulated conductors, located respectively in the wings of the external member. The insertion of a wedge in the intermediate member causes the engagement of these perforating means with the insulating covering and the consequent establishment of an electrical connection between both conductors.

Nevertheless, this connector has the drawback that it allows a large relative sliding between the conductor and the perforating means, whereby it frequently causes serious tears in the insulating covering, which is an unfavourable circumstance as far as obtaining a long-lasting connection is concerned.

SUMMARY OF THE INVENTION

It is an object of the invention to overcome the above-mentioned drawback. This object is achieved with a connector of the type first mentioned above which is characterised in that said intermediate member has a plurality of perforating teeth and surrounds in part at least one portion of a conductor disposed between said wedge member and said intermediate member.

The invention also contemplates that said intermediate member is C-shaped and forms two second curved wings between which there extends a generally flat portion. Each of said two second curved wings is adapted for surrounding in part a portion of one of said electrical conductors and each of them is provided with said perforating teeth projecting internally from the concave surface thereof.

Said perforating teeth preferably form pairs of teeth, in such a way that both teeth of one same pair project from respective facing longitudinal portions of a wing, in which there is formed an opening.

According to another preferred feature of the invention, in the longer transverse edge of said flat portion of said intermediate member, there extends a stop member formed by a fold, which by engagement with a transverse edge of said external member, is adapted to limit the sliding of said intermediate member relative to said external member.

BRIEF DESCRIPTION OF THE DRAWING

Further advantages and features of the invention will be appreciated from the following description, in which there disclosed a preferred embodiment of the invention, with out any limitation and with reference to the enclosed drawings, in which.

DETAILED DESCRIPTION OF THE INVENTION

Figure 1:
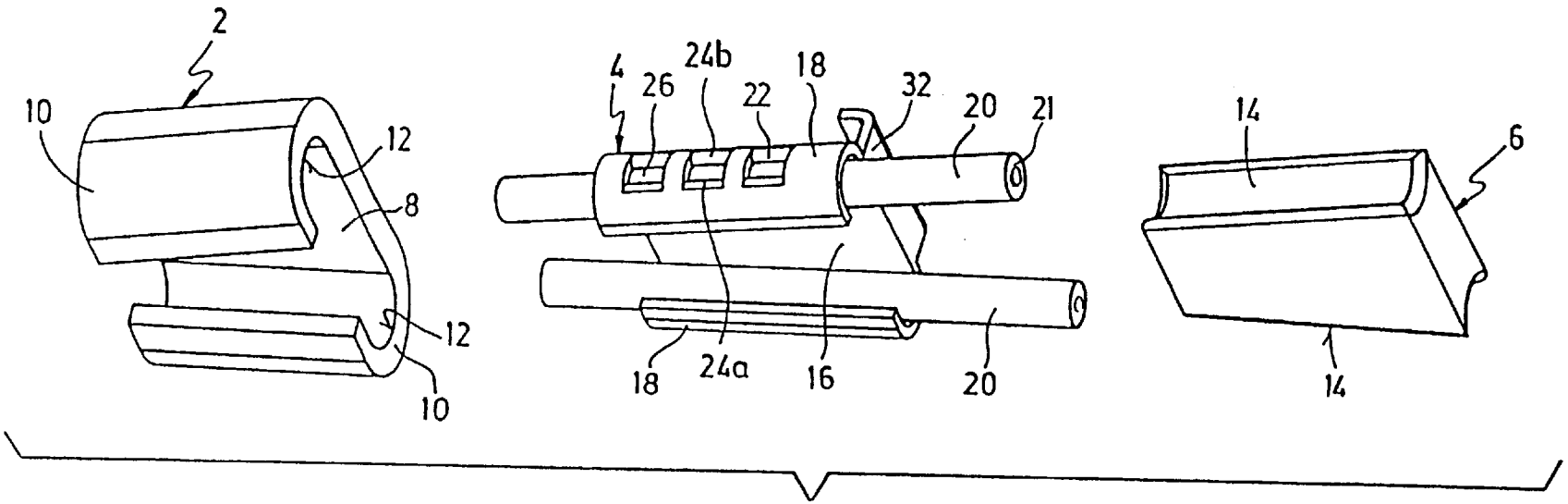
FIG. 1 is an exploded perspective view of the constituent members of the connector of the invention.

The connector of the invention comprises an external member 2, an intermediate member 4 and a wedge member 6.

The external member 2 is C-shaped. It is intended with this expression to signify that the cross sections of the external member would reproduce the shape of this letter. The external member is formed by a plate 8 from which there extend two first curved wings 10 and it is pointed out that the bottoms 12 of these wings 10 define longitudinal lines inclined towards each other. As a result of this, the two transverse edges of the plate 8 are unequal.

The wedge member 6 is provided with two active edges 14 forming respective concavities and which are inclined towards each other, in an angular magnitude substantially equal to that defined by the bottoms 12 of the wings 10 of the external member 2.

Figure 2:
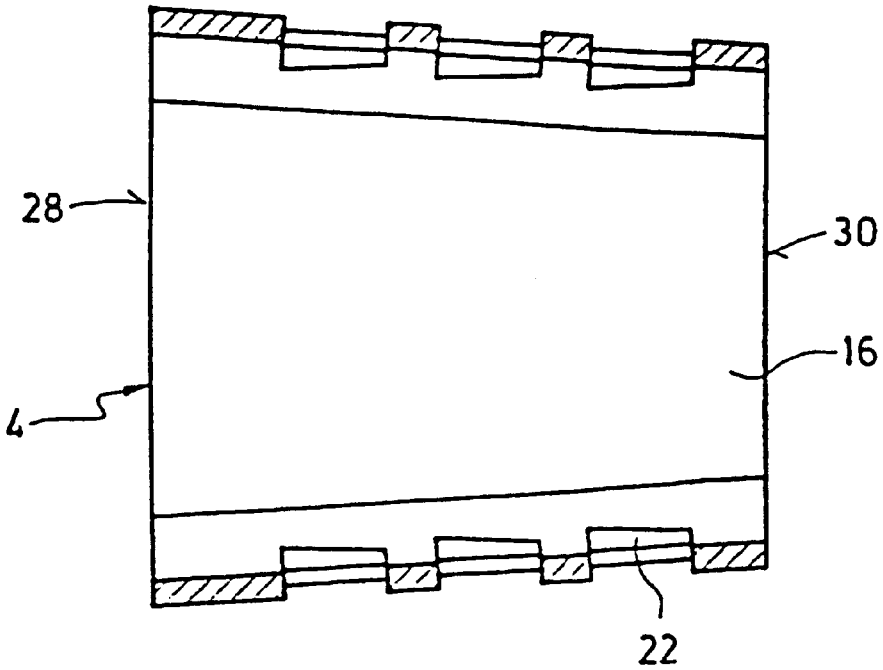
FIG. 2 is a cross section view on the line II—II of FIG. 3.
Figure 3:
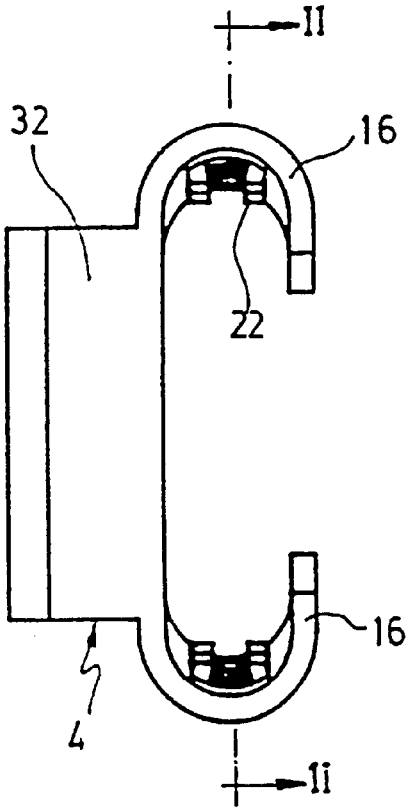
FIG. 3 is a front elevation view of the intermediate member.

The intermediate member 4 comprises electrically conducting material. It is also C-shaped, i.e., it is also formed by a plate 16 from which there extend two second wings 18, each of which is adapted to surround in part a portion of a corresponding electrical conductor 20, covered by an insulating covering 21. As described hereinafter, when the connector is in use, the intermediate member 4 is located between the external member 2 and the wedge member 6, whereby there is an inclination between the wings 18 similar to those of the other two members. Because of this inclination, the plate 16 is provided with two transverse end edges 28, 30 (FIG. 2), of different length.

Each of the wings 18 of the intermediate member 4 is provided with a plurality of perforating teeth 22 which are capable of perforating the insulating covering 21 and which project inwardly of a wing 18, from the concave internal surface thereof. These teeth 22 preferably form pairs, in such a way that two teeth 22 of one same pair project from facing longitudinal portions 24*a*, 24*b*, forming an opening 26.

It is easy to understand the use of the connector from the foregoing description. Two conductors 20 are inserted in the intermediate member 4 and this is inserted thereafter in the external member 2. When the wedge member 6 is subsequently inserted, the electrical conductors 20 are strongly pressed against the teeth 22, whereby appropriate perforation of the conductors is achieved. The limit of movement in a longitudinal direction of the connector parts is effected by engagement of the stop member 32 against the longer transverse edge 28 of the plate 8.

It is should be noted that the sliding that occurs between the parts of the connector of the invention take place, on the one hand, between the outer surface of the wings 18 and the respective bottoms 12 of the wings of the external member 2 and, on the other hand, between the active edges 14 of the wedge member 6 and the electrical conductors 20 themselves. None of these movements is liable to cause serious tears in the covering 21 of the conductors and thus a long life is assured for the present connector.

Any source of power is suitable for the mechanical assembly of the connector, either of hydraulic origin, provided by a cartridge or any other. Obviously, where small sized connectors are concerned, they may be easily assembled with the simple aid of hand tools.

What is claimed is:

1. Wedge connector with insulation perforating device, for connecting electrical conductors provided with an insulating covering, comprising: an external C-shaped member (2), determining two first curved wings (10), each having respective bottoms (12) which define mutually inclined longitudinal lines; a wedge member (6) having two mutually inclined concave active edges (14); and at least one intermediate member (4) comprising electrically conducting material and which is adapted to be located between said external member (2) and said wedge member (6), characterised in that said intermediate member (4) has a plurality of perforating teeth (22) and surrounds in part at least one portion of a conductor (20) disposed between said wedge member (6) and said intermediate member (4).

2. The connector of claim 1, characterised in that said intermediate member (4) is C-shaped and forms two second curved wings (18) between which there extends a generally flat portion (16); each of said two second curved wings (18) being adapted for surrounding in part a portion of one of said electrical conductors (20) and each of them is provided with said perforating teeth (22) projecting internally from the concave surface thereof.

3. The connector of claim 1, characterised in that said perforating teeth (22) form pairs of teeth, in such a way that both teeth (22) of one same pair project from respective facing longitudinal portions **(24*a*, 24*b*) of a second wing (18), in which they delimit an opening (26)**.

4. Wedge connector with insulation perforating device, for connecting electrical conductors provided with an insulating covering, comprising: an external C-shaped member (2), determining two first curved wings (10), each having respective bottoms (12) which define mutually inclined longitudinal lines; a wedge member (6) having two mutually inclined concave active edges (14); and at least one intermediate member (4) comprising electrically conducting material and which is adapted to be located between said external member (2) and said wedge member (6), characterised in that said intermediate member (4) has a plurality of perforating teeth (22) surrounds in part at least one portion of a conductor (20) disposed between said wedge member (6) and said intermediate member (4), wherein the intermediate member (4) has a stop member (32) formed by a fold, which by engagement with a transverse edge of said external member (2), is adapted to limit the sliding of said intermediate member (4) relative to said external member (2).

5. The connector of claim 1 charachterised in that said intermediate member is directly received in said external C-shaped member.

6. The connector of claim 1, wherein at least one of said electrical conductors is provided with an insulating covering.

7. The connector of claim 4, wherein said intermediate member (4) has a flat portion (16) with a longer transverse edge, and wherein in the longer transverse edge there extends said stop member (32).

* * * * *